United States Patent [19]

Metts et al.

[11] Patent Number: 5,023,850

[45] Date of Patent: Jun. 11, 1991

[54] CLOCK FOR KEEPING TIME AT A RATE OTHER THAN HUMAN TIME

[76] Inventors: Rodney H. Metts, 520 Amherst Ave., Columbia, S.C. 29205; Barry D. Thomas, 560 Powder Springs Rd. Apt. 15A2, Marietta, Ga. 30064

[21] Appl. No.: 550,167

[22] Filed: Jul. 9, 1990

Related U.S. Application Data

[63] Continuation-in-part of Ser. No. 411,740, Sep. 25, 1989, abandoned.

[51] Int. Cl.[5] ..... G04B 19/24; G04B 25/00

[52] U.S. Cl. ..... 368/28; 368/62; 368/223

[58] Field of Search ..... 368/10, 28–30, 368/15–20, 62, 78, 80, 64, 66, 204, 223

[56] References Cited

U.S. PATENT DOCUMENTS

| | | | |
|---|---|---|---|
| 463,101 | 11/1891 | Cory | 368/15 |
| 3,629,709 | 12/1971 | Engdahl | 368/15 |
| 3,766,727 | 10/1973 | Didik | 368/15 |
| 3,908,353 | 9/1975 | Graziano | 368/204 |
| 4,175,378 | 11/1979 | Shelton | 368/221 |
| 4,201,039 | 5/1980 | Marion | 368/204 |
| 4,541,726 | 9/1985 | Rachofsky | 368/80 |
| 4,763,311 | 8/1988 | Marvosh | 368/223 |

*Primary Examiner*—Vit W. Miska

[57] ABSTRACT

A novelty clock, watch, and the like for keeping time at an animal's rate, defined in terms of a multiple of human rate by dividing the average lifetime of a particular animal into the average lifetime of a human being. The multiple for dogs is seven, for example. The device comprises a housing, a source of reference frequency for producing pulses, means for producing 60 pulses per second times the multiple for the particular animal, means for accumulating time, and means for displaying time. The display is the usual clock face with the speed of the hands altered, preferably also with the data indicated as the number of days since the last "new year" in animal days. A digital display of time in human terms may be provided with an analog display of time in animal terms or, alternatively, a capability to switch from one to the other may be provided. Preferably, a variable resistor, between the frequency source and producing means allows the user to change the multiple for diferent types of animals.

8 Claims, 3 Drawing Sheets

CLOCK FOR KEEPING TIME AT A RATE OTHER THAN HUMAN TIME

This is a continuation-in-part of copending application Ser. No. 07/411,740 filed on Sept. 25, 1989 abandoned.

BACKGROUND OF THE INVENTION

1. Field of the Invention

The present invention relates to novelty clocks, watches, and the like for keeping time at a rate other than human time.

2. Discussion of Background

Watches, clocks, and the like keep track of the passage of time on a human scale, or in terms of human time. Specifically, a day is defined by a single rotation of the earth on its axis; the day is then divided arbitrarily into twenty-four hours. Each hour is divided into minutes, the minutes into seconds. A day, a minute, a second have value to a human being in terms of the lifetime of a man; a week has a greater value than a day; a year, a greater value still. Humans schedule their activities with these values in mind.

Animals, such as dogs, live shorter lives as measured by human time than people. A dog that lives ten years has lived a full life; a man might live 77 years to live a full life. The relationship between the lifetimes of humans and dogs can be related by stating a period of time in "dog years." Two human years is fourteen "dog years." Although this relationship might perhaps be helpful in determining whether a dog or other animal is full grown or not, it does little to help the owner of a pet put the proper value on the animal's time. Various animals have different lifetimes. For example, seahorses and rats live an average of three human years; pigeons live three and one-half years; goldfish and hamsters live five human years; hogs, 9 years; dogs, 11 years; cats, 18 years, beavers, 12 years; lobsters, 15 years; bats, lions, and horses live 20 years; dolphins live 25 years; brown bears live 47 years and polar bears live 33 years; gorillas live 45 years; alligators, 50 years; elephants, 60 years; and giant tortoises, 100 years. All of these have a corresponding multiple to relate to them to human time.

SUMMARY OF THE INVENTION

According to its major aspects, the present invention is a watch, clock or the like made to run at a time different than human time, such as a multiple of human time to correspond to the ratio of "animal years" per "human year." The number of animal years per human year ratio is derived from the ratio of the lifetime of a human being to the lifetime of that particular animal, in the same units. For example a dog lives about 11 years while a human lives about 77 years; therefore, the ratio is seven. The watch comprises a housing containing a timing means for keeping time at a rate different than human time and a means for displaying the time at that different rate. The display would preferably show the standard twelve hour analog display with the hands revolving, say, seven times faster for dog time so that seven "dog days" would elapse in the time it takes for one "human day." Further, the date would also be displayed with a designation of "Dog Day" followed by the number of dog days elapsed during the dog year so that the human date of June 14th (at about 9:00 AM) would be displayed as DOG DAY 56th (8:00 AM) in "dog" time. Preferably, the watch would change the reference frequency used for keeping human time, such as the frequency of a quartz crystal or the frequency of household current from which the watch also derives its power. Most preferably the watch would display human time and human date simultaneously, perhaps by a digital display as the different rate of time is displayed by analog means or be capable of shifting from human time to animal time or animal rate of time.

It is a feature of the present invention that the rate of time, as it is perceived by humans will have the appropriate value for the animal to which the rate corresponds. If the watch is set for dog time, the hands will move about the watch face seven times faster than the rate of human time. The advantage of this feature is that the value to the animal of the duration of the activity in which the animal is engaged at its owner's pleasure will be put into perspective. If a dog is kept locked in the basement of a house during an eight or nine hour day, for example, while its owner is away, the elapsed time on the dog watch will be 56 to 63 hours, or approximately two and one-half days. A one-hour ride in an automobile will register seven hours on a dog watch. Thus the value in dog time of a human activity will become quickly apparent.

Another advantage of this feature is that the appearance of hands moving about a watch face at a rate seven times faster than expected has an unexpectedly comic effect. This comic effect can be taken advantage of by using the watch as an official time piece for a potentially dull meeting. Another feature of the present invention is circuitry to display simultaneously the date and time in both human and animal terms. The advantage of this feature is that it enables a human wearer to know the time and date both for himself and his pet.

These and other features and advantages will be apparent to those skilled in the art of watches from the following drawings and detailed description.

DETAILED DESCRIPTION OF A PREFERRED EMBODIMENT

Figure 1:
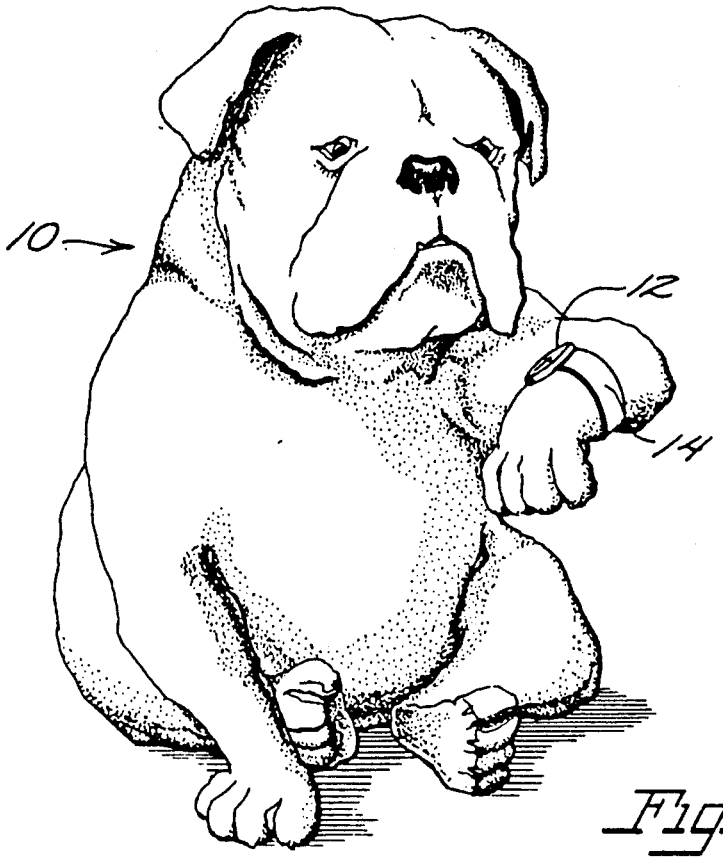
FIG. 1 shows a watch according the present invention in the form of a wristwatch worn by a typical dog.

FIG. 1 depicts a dog 10 wearing a wristwatch 12. Alternative embodiments of the present invention encompass, wall clocks, pocket watches, mantle clocks, and the like, whether worn by animals not limited to dogs, or by humans. If worn by animals, watches according to the present invention are preferably secured by a strap 14 with VELCRO ends for ease of application but may also be secured by the conventional belt and buckle. The material used for the straps is preferably a synthetic material that is not easily chewed through.

Figure 2:
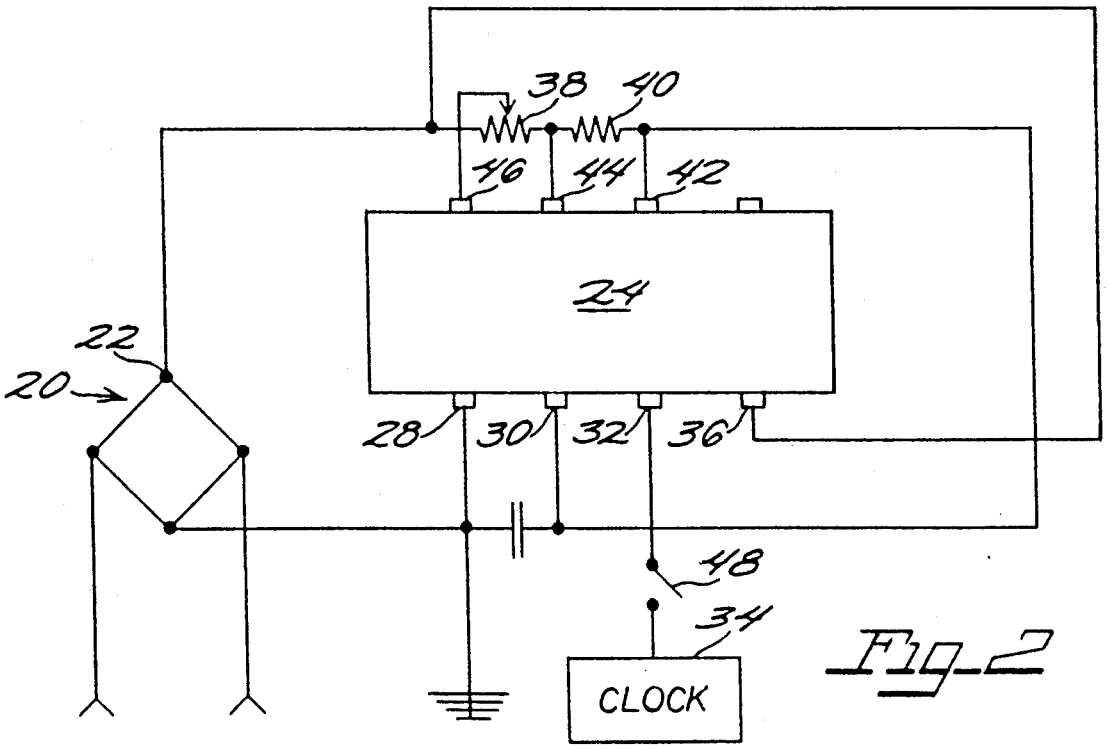
FIG. 2 is a diagram of electrical circuitry for changing the rate of human time based on a 60 hertz reference frequency according to an embodiment of the present invention.

FIG. 2 is a diagram of circuitry for use in converting a watch that uses a 60 hertz reference frequency for keeping time, the frequency of ordinary household current. Other sources of timing, such as quartz crystals, can be used to provide a different reference frequency. The circuit shown uses a source of direct current voltage, approximately 4 volts, provided by rectifier 20 upon receiving ten volts alternating current from a source (not shown). The output 22 of rectifier 20 is fed to a standard timer integrated circuit 24, such as an NE555 manufactured by Signetics, National Semiconductor and others.

The timer integrated circuit 24 is composed of two internal comparators and an internal flip flop switch and functions in the circuit shown as an oscillator by alternatingly charging and discharging a capacitor 26. Pin 28 of timer 24 goes to ground; pin 30 is a preset voltage feeding to capacitor 26. Pin 32 is the logic output of the timer, alternating between high and low, and is connected to a clock 34 that normally keeps track of the passage of time based on a 60 hertz input reference signal, such as that made by Radio Shack, Catalog No. 63-754, wherein pin 32 of timer 24 would be fed to pin number 25 of that clock's integrated circuit. Pin 36 is connected to the supply, logic high, voltage to make the timer oscillate.

The DC supply voltage is dropped across two resistors: a variable resistor 38 and a nonvariable resistor 40. Pin 42 is the low voltage threshold of timer 24's internal comparator and is connected to capacitor 26. Pin 44 discharges a capacitor internal to timer 24 which voltage is between that fed to pin 42 and to pin 46, dropped across resistors 38 and 40. The voltage to pin 46 is the timer supply voltage and may be varied depending on the setting of variable resistor 38. A smaller voltage drop across resistor 38 produces a higher multiple of the reference voltage.

In the preferred embodiment, a switch 48 is located between timer 24 and clock 34 so that clock 34 can run at human time rather than at a multiple of human time. Variable resistor may be adjustable externally so that a watch embodying the present invention can be adapted for different animals or breeds of animals.

It will be obvious that a geared watch having an additional gear for moving the hands of the watch at a higher rate of speed can also be fashioned in lieu of an electronic watch, however, it is preferable to be able to backfit existing clock mechanisms and to allow for the dual or alternate display of human and animal time. It is also preferable to display animal time in analog format, such as with moving "hands" and to display human time in digital format.

In the specific illustration given, Resistor 38 is preferably 100 kOhms, resistor 40 is one kOhm, capacitor 26 is 0.022 microfarads, timer 24 is an NE555, connected to a Radio shack digital alarm clock catalog #63-754, having a 10 V A C input rectified to 4 VDC. Variable resistor 38, having a value of 1000 kOhms, will allow, in this circuit, a variation of plus or minus 20 percent about a multiplier of 7 on the reference voltage, or in the range 5.6 to 8.4. It will be apparent to those skilled in the art that broader ranges are possible.

Figure 3:
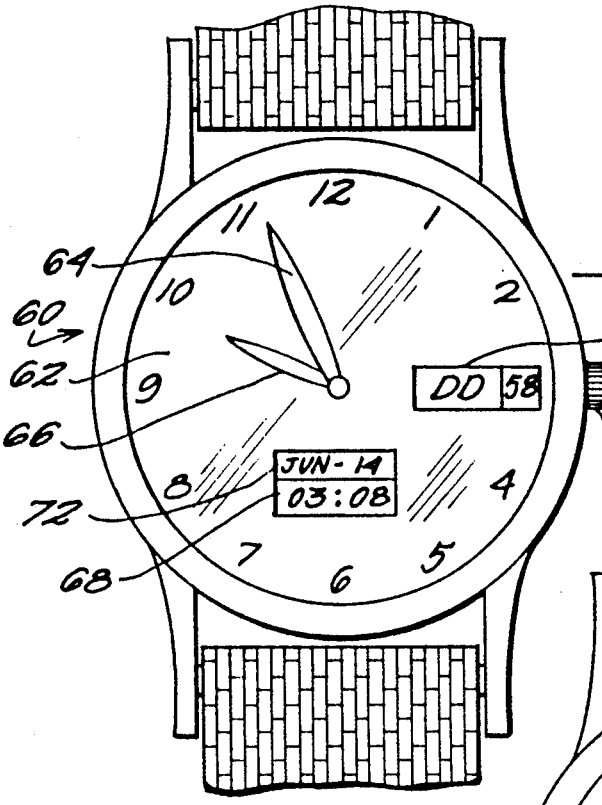
FIG. 3 shows a wrist watch according to a preferred embodiment of the present invention.

FIG. 3 shows an example of a clock or a wrist watch 60 according to one embodiment of the present invention. Clock 60 has a clock face 62 with numerals one through twelve as in a conventional clock face. The time and date are displayed in two ways. There is an analog display of time, using the usual convention of two hands, one long hand 64 for minutes and one short hand 66 for hours, for animal time and there is a digital display of time at 68 in human time. The date is indicated in animal days at 70 and in human days at 72, just below the display of human time. Preferably, as shown in FIG. 3, the animal date would simply be designated "DD" for Dog Days (as shown in FIG. 3) or "CD" for cat days followed by the number of days since the most recent dog or cat "new year", respectively. Each animal year has an arbitrary number of animals days in it. A dog year could have 365 dog days in it for seven new years in a 365 human day year. For example, in the case of dog time, June 14th at approximately 3:08 PM in human days would be Dog Day 58 (after the third "new year" in that calendar year) at approximately 9:56 AM. Of course, the time and date can be set using conventional means such as a stem 72.

Figure 4:
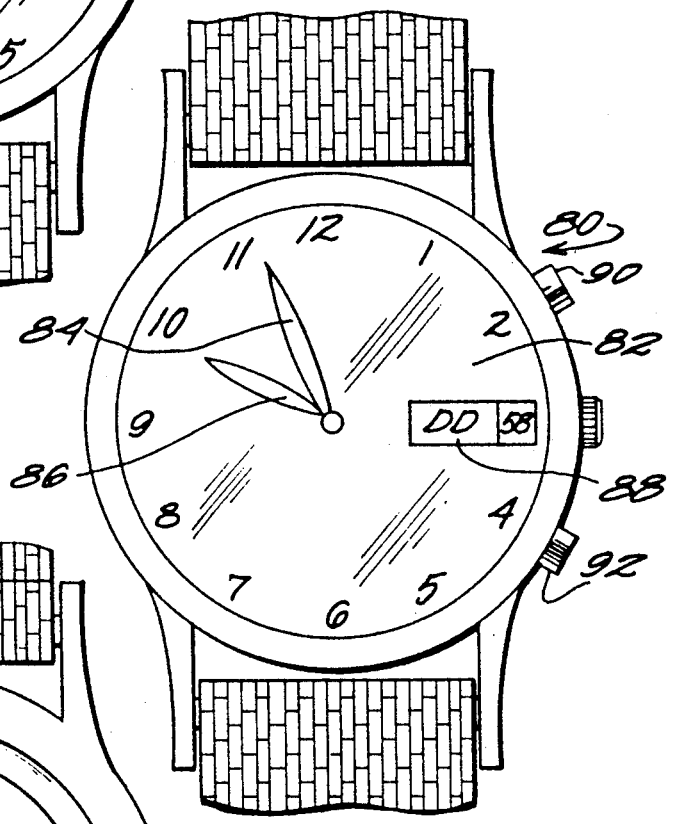
FIG. 4 shows an alternative wrist watch according to the present invention.

FIG. 4 shows a different wrist watch, generally indicated by the reference character 80. Clock 80 also has a face 82, a long hand 84 and a short hand 86 for displaying, in usual analog fashion, the time, and a display 88 for the date. Clock 80 has two pushbuttons 90 and 92 on the side. Pushbutton 90 changes the display of human time and date to animal time and date and back again. Pushbutton 92 changes the rate at which hands 84 and 86 move from the rate of human time to the rate of animal time. If a human wearer wants to keep tract of animal time, he or she can simply press pushbutton 90. If, however, a wearer is displaying human time and wants human time to pass faster, say during a business meeting, he or she may simply press pushbutton 92 and hands 84 and 86 will simply turn at animal rate, but the display will not shift to animal time. Watch 80 is preferably one which has liquid crystal simulated hands to shift from human to animal time more easily.

Figure 5:
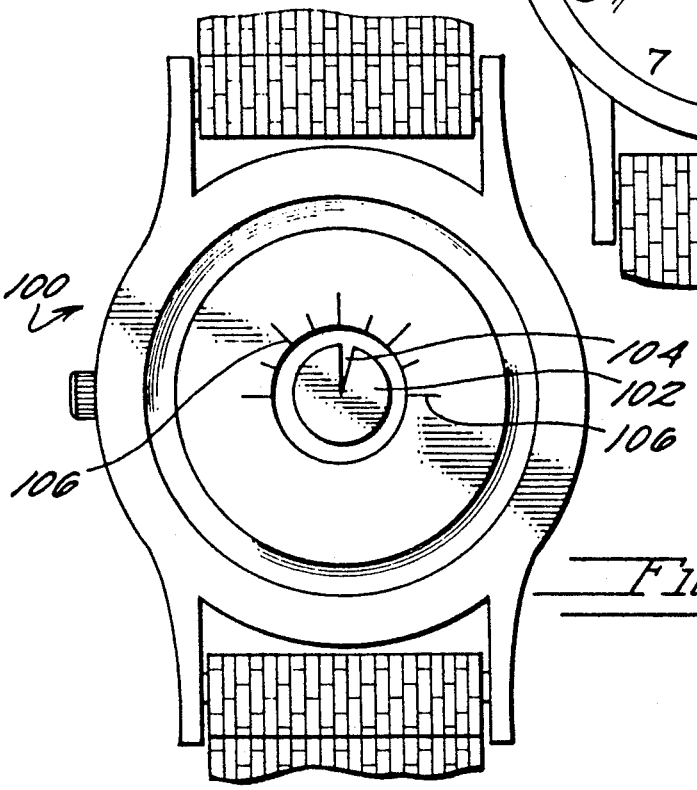
FIG. 5 shows the multiplier control on the back of a wrist watch according to the present invention.

FIG. 5 shows the back of a wristwatch, generally indicated by reference character 100, which has a low-profile dial 102 with a cut-out portion 104 and markings 106. Dial 102 rotates to allow the user to change the multiple at which watch 100 runs with respect to human time. Dial 102 is in operative connection with a variable resistor inside watch 100, such as variable resistor 38 of FIG. 2.

Figure 6:
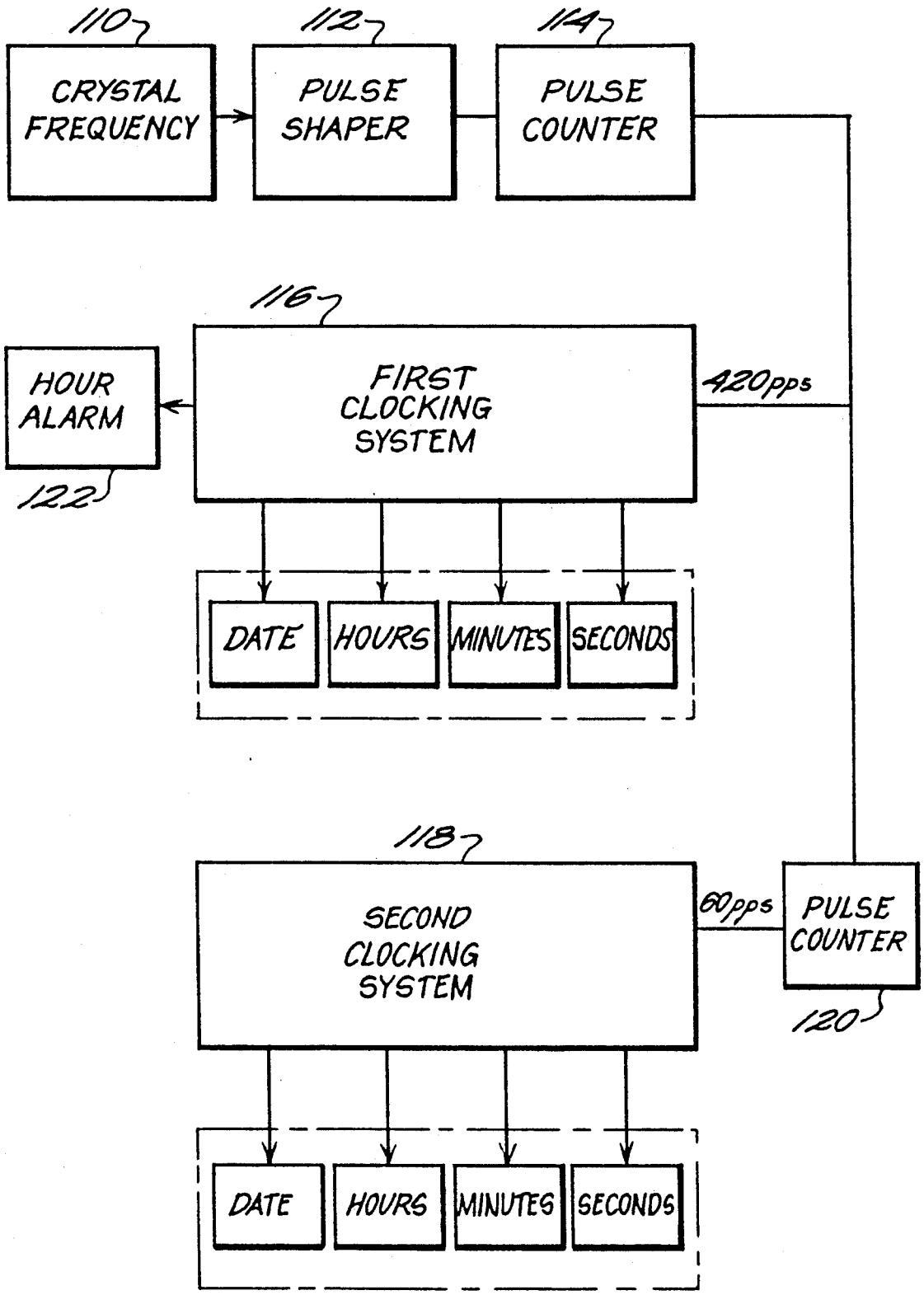
FIG. 6 is a block diagram of a clock having the capability to display human and dog time.

FIG. 6 shows a block diagram of a circuit for a digital clock for keeping time at both a human and an animal rate. The clock has a quartz crystal that generates a frequency 110 at a multiple of the frequency required for the clock to operate. The frequency cycles are shaped into pulses by a pulse shaper 112 and fed to a first pulse counter 114 that counts out a multiple of 60 pulses per second for keeping tract of animal time, which for dogs is seven times human time or 420 pulses per second. A first clocking system 116 keeps track of dog time, in this example; a second clocking system 118 separated from first clocking system 116 by a second pulse counter 120 that reduces the pulse rate fed to second clocking system 118 to 60 per second keeps tract of time at a human rate. First clocking system 116 has a display 124 of dog time, in hours minutes and seconds, and the dog date. Second clocking system 118 has a display 126 of human time, in hours, minutes, and seconds, and the human date. When first clocking system 116 counts sufficient pulses to increment the hour, a chirp alarm 122 enunciates at a frequency that is preferably audible only to the animal, such as 25 kHz for dogs. In a watch strapped to the paw of a dog, for example, this chirp alarm is likely to produce a response from the dog which will appear to a human as a response to the time, with comic effect.

It will be obvious that many modifications may be made to the existing embodiment without departing from the spirit and scope of the present invention which is defined by the following claims.

What is claimed is:

1. A clock for keeping animal time, wherein animal time is defined as human time multiplied by a ratio given by the average lifespan of a human divided by the average lifespan of a type of animal whereby an animal second is equal to one human second divided by said ratio, one animal minute is equal to one human minute divided by said ratio, one animal hour is equal to one human hour divided by said ratio, and one animal day is equal to one human day divided by said ratio, said clock comprising:

a housing;

means for generating a reference frequency;

first means responsive to said generating means for producing pulses at a rate of sixty pulses per second times said ratio;

first clocking means for accumulating said pulses from said first producing means and producing an animal time output signal in animal hours, animal minutes and animal seconds;

second means responsive to said generating means for producing pulses at a rate of sixty pulses per second; and second clocking means for accumulating said pulses from said second producing means and producing a human time output signal in human hours, human minutes and human seconds.

2. The clock as recited in claim 1, further comprising first display means responsive to said first clocking means for displaying said animal time output signal.

3. The clock as recited in claim 2, further comprising second display means responsive to said second clocking means for displaying said human time output signal.

4. The clock as recited in claim 2, further comprising first date means responsive to said first clocking means for keeping track of animal days and whereas said first display means displays an animal date as a number of said animal days in a year of arbitrary length.

5. The clock as recited in claim 1, further comprising first display means responsive to both said first clocking means and said second clocking means; and means for switching from said first clocking means to said second clocking means, said first display means displaying alternatively animal time and human time.

6. A clock for keeping animal time, wherein animal time is defined as human time multiplied by a ratio given by the average lifespan of a human divided by the average lifespan of a type of animal whereby an animal second is equal to one human second divided by said ratio, one animal minute is equal to one human minute divided by said ratio, one animal hour is equal to one human hour divided by said ratio, and one animal day is equal to one human day divided by said ratio, said clock comprising:

a housing;

means for generating a reference frequency;

first means responsive to said generating means for producing pulses at a rate of sixty pulses per second times said ratio;

first clocking means for accumulating said pulses from said first producing means and producing an animal time output signal in animal hours, animal minutes and animal seconds;

first display means responsive to said first clocking means for displaying said animal time output signal; and means for varying said ratio to correspond to average life spans of different types of animals.

7. The clock as recited in claim 6, further comprising:

second means responsive to said generating means for producing pulses at a rate of sixty pulses per second; and second clocking means for accumulating said pulses from said second producing means and producing a human time output signal in human hours, human minutes and human seconds.

8. The clock as recited in claim 6, wherein said ratio can be varied from 5.6 to 8.4.

* * * * *